US007878178B2

(12) United States Patent
Stewart et al.

(10) Patent No.: US 7,878,178 B2
(45) Date of Patent: Feb. 1, 2011

(54) EMISSIONS SENSORS FOR FUEL CONTROL IN ENGINES

(75) Inventors: Gregory E. Stewart, North Vancouver (CA); Michael L. Rhodes, Richfield, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 12/144,445

(22) Filed: Jun. 23, 2008

(65) Prior Publication Data

US 2008/0249697 A1 Oct. 9, 2008

Related U.S. Application Data

(63) Continuation of application No. 11/206,404, filed on Aug. 18, 2005, now Pat. No. 7,389,773.

(51) Int. Cl.
*F02D 41/00* (2006.01)

(52) U.S. Cl. ..... 123/436; 123/672; 701/110

(58) Field of Classification Search ..... 123/436, 123/672, 691, 480, 703; 701/103–105, 109–110; 60/285–286

See application file for complete search history.

(56) References Cited

U.S. PATENT DOCUMENTS 3,744,461 A 7/1973 Davis
4,005,578 A 2/1977 McInerney
4,055,158 A 10/1977 Marsee
4,252,098 A 2/1981 Tomczak et al.
4,383,441 A 5/1983 Willis et al.
4,426,982 A 1/1984 Lehner et al.
4,438,497 A 3/1984 Willis et al.
4,456,883 A 6/1984 Bullis et al.
4,485,794 A 12/1984 Kimberley et al.
4,601,270 A 7/1986 Kimberley et al.
4,653,449 A 3/1987 Kamei et al.
5,044,337 A 9/1991 Williams
5,076,237 A 12/1991 Hartman et al.

(Continued)

FOREIGN PATENT DOCUMENTS

DE 10219832 11/2002

(Continued)

OTHER PUBLICATIONS

"SCR, 400-csi Coated Catalyst," Leading NOx Control Technologies Status Summary, 1 page prior to the filing date of the present application.

(Continued)

*Primary Examiner*—Hai H Huynh
(74) *Attorney, Agent, or Firm*—Seager Tufte & Wickhern LLC

(57) ABSTRACT

A system for controlling fuel to an engine to minimize emissions in an exhaust of the engine. There may be a controller connected to an actuator, for example a fuel control actuator, of the engine and to emissions sensors, such as an NOx and/or PM sensor, proximate to an exhaust output of the engine. The controller, for example a speed controller, may have an input connected to an output of a pedal or desired speed setting mechanism. A speed sensor at a power output of the engine may be connected to an input of the controller.

22 Claims, 5 Drawing Sheets

U.S. PATENT DOCUMENTS

| | | | | |
|---|---|---|---|---|
| 5,089,236 | A | 2/1992 | Clerc | |
| 5,094,213 | A * | 3/1992 | Dudek et al. | 477/121 |
| 5,108,716 | A | 4/1992 | Nishizawa | |
| 5,123,397 | A | 6/1992 | Richeson | |
| 5,233,829 | A | 8/1993 | Komatsu | |
| 5,270,935 | A * | 12/1993 | Dudek et al. | 701/99 |
| 5,282,449 | A | 2/1994 | Takahashi et al. | |
| 5,293,553 | A * | 3/1994 | Dudek et al. | 701/102 |
| 5,349,816 | A | 9/1994 | Sanbayashi et al. | |
| 5,365,734 | A | 11/1994 | Takeshima | |
| 5,394,331 | A * | 2/1995 | Dudek et al. | 701/106 |
| 5,398,502 | A | 3/1995 | Watanabe | |
| 5,452,576 | A | 9/1995 | Hamburg et al. | |
| 5,477,840 | A | 12/1995 | Neumann | |
| 5,560,208 | A | 10/1996 | Halimi et al. | |
| 5,570,574 | A | 11/1996 | Yamashita et al. | |
| 5,598,825 | A | 2/1997 | Neumann | |
| 5,609,139 | A | 3/1997 | Ueda et al. | |
| 5,611,198 | A | 3/1997 | Lane et al. | |
| 5,690,086 | A | 11/1997 | Kawano et al. | |
| 5,692,478 | A | 12/1997 | Nogi et al. | |
| 5,746,183 | A | 5/1998 | Parke et al. | |
| 5,765,533 | A | 6/1998 | Nakajima | |
| 5,771,867 | A | 6/1998 | Amstutz et al. | |
| 5,785,030 | A | 7/1998 | Paas | |
| 5,788,004 | A | 8/1998 | Friedmann et al. | |
| 5,846,157 | A | 12/1998 | Reinke et al. | |
| 5,893,092 | A | 4/1999 | Driscoll | |
| 5,942,195 | A | 8/1999 | Lecea et al. | |
| 5,964,199 | A | 10/1999 | Atago et al. | |
| 5,974,788 | A | 11/1999 | Hepburn et al. | |
| 6,029,626 | A | 2/2000 | Bruestle | |
| 6,035,640 | A | 3/2000 | Kolmanovsky et al. | |
| 6,048,628 | A | 4/2000 | Hillmann et al. | |
| 6,055,810 | A | 5/2000 | Borland et al. | |
| 6,058,700 | A | 5/2000 | Yamashita et al. | |
| 6,067,800 | A | 5/2000 | Kolmanovsky et al. | |
| 6,076,353 | A | 6/2000 | Fruedenberg et al. | |
| 6,105,365 | A | 8/2000 | Deeba et al. | |
| 6,134,883 | A | 10/2000 | Kato et al. | |
| 6,153,159 | A | 11/2000 | Engeler et al. | |
| 6,161,528 | A | 12/2000 | Akao et al. | |
| 6,170,259 | B1 | 1/2001 | Boegner et al. | |
| 6,171,556 | B1 | 1/2001 | Burk et al. | |
| 6,178,743 | B1 | 1/2001 | Hirota et al. | |
| 6,178,749 | B1 | 1/2001 | Kolmanovsky et al. | |
| 6,216,083 | B1 | 4/2001 | Ulyanov et al. | |
| 6,233,922 | B1 | 5/2001 | Maloney | |
| 6,237,330 | B1 | 5/2001 | Takahashi et al. | |
| 6,242,873 | B1 | 6/2001 | Drozdz et al. | |
| 6,263,672 | B1 | 7/2001 | Roby et al. | |
| 6,273,060 | B1 | 8/2001 | Cullen | |
| 6,279,551 | B1 | 8/2001 | Iwano et al. | |
| 6,312,538 | B1 | 11/2001 | Latypov et al. | |
| 6,321,538 | B2 | 11/2001 | Hasler | |
| 6,338,245 | B1 | 1/2002 | Shimoda et al. | |
| 6,341,487 | B1 | 1/2002 | Takahashi et al. | |
| 6,347,619 | B1 | 2/2002 | Whiting et al. | |
| 6,360,159 | B1 | 3/2002 | Miller et al. | |
| 6,360,541 | B2 | 3/2002 | Waszkiewicz et al. | |
| 6,360,732 | B1 | 3/2002 | Bailey et al. | |
| 6,363,715 | B1 | 4/2002 | Bidner et al. | |
| 6,379,281 | B1 | 4/2002 | Collins et al. | |
| 6,389,803 | B1 | 5/2002 | Surnilla et al. | |
| 6,425,371 | B2 | 7/2002 | Majima | |
| 6,427,436 | B1 | 8/2002 | Allansson et al. | |
| 6,431,160 | B1 | 8/2002 | Sugiyama et al. | |
| 6,446,430 | B1 | 9/2002 | Roth et al. | |
| 6,463,733 | B1 | 10/2002 | Asik et al. | |
| 6,463,734 | B1 | 10/2002 | Tamura et al. | |
| 6,470,886 | B1 | 10/2002 | Jestrabek-Hart | |
| 6,502,391 | B1 | 1/2003 | Hirota et al. | |
| 6,512,974 | B2 | 1/2003 | Houston et al. | |
| 6,546,329 | B2 | 4/2003 | Bellinger | |
| 6,550,307 | B1 * | 4/2003 | Zhang et al. | 73/23.32 |
| 6,553,754 | B2 | 4/2003 | Meyer et al. | |
| 6,560,528 | B1 | 5/2003 | Gitlin et al. | |
| 6,560,960 | B2 | 5/2003 | Nishimura et al. | |
| 6,571,191 | B1 | 5/2003 | York et al. | |
| 6,579,206 | B2 | 6/2003 | Liu et al. | |
| 6,591,605 | B2 | 7/2003 | Lewis | |
| 6,594,990 | B2 | 7/2003 | Kuenstler et al. | |
| 6,612,293 | B2 | 9/2003 | Schweinzer et al. | |
| 6,625,978 | B1 | 9/2003 | Eriksson et al. | |
| 6,629,408 | B1 | 10/2003 | Murakami et al. | |
| 6,647,710 | B2 | 11/2003 | Nishiyama et al. | |
| 6,647,971 | B2 | 11/2003 | Vaughan et al. | |
| 6,651,614 | B2 | 11/2003 | Flamig-Vetter et al. | |
| 6,666,198 | B2 | 12/2003 | Mitsutani | |
| 6,671,603 | B2 | 12/2003 | Cari et al. | |
| 6,672,052 | B2 | 1/2004 | Taga et al. | |
| 6,672,060 | B1 | 1/2004 | Buckland et al. | |
| 6,679,050 | B1 | 1/2004 | Takahashi et al. | |
| 6,687,597 | B2 | 2/2004 | Sulatisky et al. | |
| 6,688,283 | B2 | 2/2004 | Jaye | |
| 6,694,244 | B2 | 2/2004 | Meyer et al. | |
| 6,694,724 | B2 | 2/2004 | Tanaka et al. | |
| 6,705,084 | B2 | 3/2004 | Allen et al. | |
| 6,718,753 | B2 | 4/2004 | Bromberg et al. | |
| 6,736,120 | B2 | 5/2004 | Surnilla | |
| 6,739,122 | B2 | 5/2004 | Kitajima et al. | |
| 6,742,330 | B2 | 6/2004 | Genderen | |
| 6,743,352 | B2 | 6/2004 | Ando et al. | |
| 6,752,131 | B2 | 6/2004 | Poola et al. | |
| 6,752,135 | B2 | 6/2004 | McLaughlin et al. | |
| 6,758,037 | B2 | 7/2004 | Terada et al. | |
| 6,760,658 | B2 * | 7/2004 | Yasui et al. | 701/106 |
| 6,772,585 | B2 | 8/2004 | Iihoshi et al. | |
| 6,779,344 | B2 | 8/2004 | Hartman et al. | |
| 6,779,512 | B2 | 8/2004 | Mitsutani | |
| 6,788,072 | B2 | 9/2004 | Nagy et al. | |
| 6,789,533 | B1 | 9/2004 | Hashimoto et al. | |
| 6,792,927 | B2 | 9/2004 | Kobayashi | |
| 6,814,062 | B2 | 11/2004 | Esteghlal et al. | |
| 6,817,171 | B2 | 11/2004 | Zhu | |
| 6,823,667 | B2 | 11/2004 | Braun et al. | |
| 6,823,675 | B2 | 11/2004 | Brunell et al. | |
| 6,826,903 | B2 | 12/2004 | Yahata et al. | |
| 6,827,060 | B2 | 12/2004 | Huh | |
| 6,827,061 | B2 * | 12/2004 | Nytomt et al. | 123/406.27 |
| 6,827,070 | B2 | 12/2004 | Fehl et al. | |
| 6,834,497 | B2 | 12/2004 | Miyoshi et al. | |
| 6,839,637 | B2 | 1/2005 | Moteki et al. | |
| 6,874,467 | B2 | 4/2005 | Hunt et al. | |
| 6,879,906 | B2 | 4/2005 | Makki et al. | |
| 6,904,751 | B2 | 6/2005 | Makki et al. | |
| 6,911,414 | B2 | 6/2005 | Kimura et al. | |
| 6,920,865 | B2 | 7/2005 | Lyon | |
| 6,925,372 | B2 * | 8/2005 | Yasui | 701/109 |
| 6,925,796 | B2 | 8/2005 | Nieuwstadt et al. | |
| 6,928,362 | B2 | 8/2005 | Meaney | |
| 6,931,840 | B2 | 8/2005 | Strayer et al. | |
| 6,941,744 | B2 | 9/2005 | Tanaka | |
| 6,945,033 | B2 | 9/2005 | Sealy et al. | |
| 6,948,310 | B2 | 9/2005 | Roberts, Jr. et al. | |
| 6,965,826 | B2 | 11/2005 | Andres et al. | |
| 6,968,677 | B2 | 11/2005 | Tamura | |
| 6,971,258 | B2 * | 12/2005 | Rhodes et al. | 73/28.01 |
| 6,978,744 | B2 | 12/2005 | Yuasa et al. | |
| 6,996,975 | B2 | 2/2006 | Radhamohan et al. | |
| 7,000,379 | B2 | 2/2006 | Makki et al. | |
| 7,013,637 | B2 | 3/2006 | Yoshida et al. | |
| 7,016,779 | B2 * | 3/2006 | Bowyer | 701/108 |
| 7,028,464 | B2 * | 4/2006 | Rosel et al. | 60/285 |

| | | | | |
|---|---|---|---|---|
| 7,047,938 | B2 | 5/2006 | Flynn et al. | |
| 7,052,434 | B2 | 5/2006 | Makino et al. | |
| 7,055,311 | B2 | 6/2006 | Beutel et al. | |
| 7,059,112 | B2 * | 6/2006 | Bidner et al. | 60/277 |
| 7,069,903 | B2 * | 7/2006 | Surnilla et al. | 123/339.19 |
| 7,082,753 | B2 | 8/2006 | Dalla Betta et al. | |
| 7,107,978 | B2 | 9/2006 | Itoyama | |
| 7,111,450 | B2 * | 9/2006 | Surnilla | 60/285 |
| 7,111,455 | B2 | 9/2006 | Okugawa et al. | |
| 7,124,013 | B2 * | 10/2006 | Yasui | 701/103 |
| 7,155,334 | B1 * | 12/2006 | Stewart et al. | 701/114 |
| 7,165,393 | B2 | 1/2007 | Betta et al. | |
| 7,165,399 | B2 * | 1/2007 | Stewart | 60/600 |
| 7,168,239 | B2 * | 1/2007 | Ingram et al. | 60/285 |
| 7,194,987 | B2 | 3/2007 | Mogi | |
| 7,200,988 | B2 | 4/2007 | Yamashita | |
| 7,204,079 | B2 | 4/2007 | Audoin | |
| 7,275,374 | B2 * | 10/2007 | Stewart et al. | 60/601 |
| 7,275,415 | B2 | 10/2007 | Rhodes et al. | |
| 7,292,926 | B2 * | 11/2007 | Schmidt et al. | 701/101 |
| 7,328,577 | B2 * | 2/2008 | Stewart et al. | 60/605.2 |
| 7,349,776 | B2 | 3/2008 | Spillane et al. | |
| 7,389,773 | B2 * | 6/2008 | Stewart et al. | 123/672 |
| 7,398,149 | B2 * | 7/2008 | Ueno et al. | 701/108 |
| 7,467,614 | B2 * | 12/2008 | Stewart et al. | 123/198 F |
| 2003/0041590 | A1 * | 3/2003 | Kitajima et al. | 60/277 |
| 2004/0006973 | A1 | 1/2004 | Makki et al. | |
| 2004/0034460 | A1 | 2/2004 | Folkerts et al. | |
| 2004/0040283 | A1 | 3/2004 | Yasui et al. | |
| 2004/0089279 | A1 * | 5/2004 | McLaughlin et al. | 123/688 |
| 2004/0128058 | A1 * | 7/2004 | Andres et al. | 701/114 |
| 2004/0226287 | A1 | 11/2004 | Edgar et al. | |
| 2005/0178675 | A1 * | 8/2005 | Hall | 205/775 |
| 2005/0210868 | A1 | 9/2005 | Funabashi | |
| 2006/0272315 | A1 | 12/2006 | Wang et al. | |
| 2010/0017094 | A1 * | 1/2010 | Stewart et al. | 701/102 |

FOREIGN PATENT DOCUMENTS

| | | |
|---|---|---|
| EP | 1221544 | 7/2002 |
| EP | 1245811 | 10/2002 |
| EP | 1686251 | 8/2006 |
| JP | 59190443 | 10/1984 |
| WO | 02101208 | 12/2002 |
| WO | 03078816 | 9/2003 |
| WO | 2004027230 | 4/2004 |

OTHER PUBLICATIONS

Advanced Petroleum-Based Fuels-Diesel Emissions Control (APBF-DEC) Project, "Quarterly Update," No. 7, 6 pages, Fall 2002.

Allanson, et al., "Optimizing the Low Temperature Performance and Regeneration Efficiency of the Continuously Regenerating Diesel Particulate Filter System," SAE Paper No. 2002-01-0428, 8 pages, Mar. 2002.

Amstuz, et al., "EGO Sensor Based Robust Output Control of EGR in Diesel Engines," IEEE TCST, vol. 3, No. 1, 12 pages, Mar. 1995.

Bemporad, et al., "Explicit Model Predictive Control," 1 page, prior to filing date of present application.

Borrelli, "Constrained Optimal Control of Linear and Hybrid Systems," Lecture Notes in Control and Information Sciences, vol. 290, 2003.

Catalytica Energy Systems, "Innovative NOx Reduction Solutions for Diesel Engines," 13 pages, 3rd Quarter, 2003.

Chatterjee, et al. "Catalytic Emission Control for Heavy Duty Diesel Engines," JM, 46 pages, prior to filing date of present application.

Delphi, Delphi Diesel NOx Trap (DNT), 3 pages, Feb. 2004.

GM "Advanced Diesel Technology and Emissions," powertrain technologies—engines, 2 pages, prior to filing date of present application.

Guzzella, et al., "Control of Diesel Engines," IEEE Control Systems Magazine, pp. 53-71, Oct. 1998.

Havelena, "Componentized Architecture for Advanced Process Management," Honeywell International, 42 pages, 2004.

Hiranuma, et al., "Development of DPF System for Commercial Vehicle—Basic Characteristic and Active Regeneration Performance," SAE Paper No. 2003-01-3182, Mar. 2003.

Honeywell, "Profit Optimizer A Distributed Quadratic Program (DQP) Concepts Reference," 48 pages, prior to filing date of present application.

http://www.not2fast.wryday.com/turbo/glossary/turbo_glossary.shtml, "Not2Fast: Turbo Glossary," 22 pages, printed Oct. 1, 2004.

http://www.tai-cwv.com/sbl106.0.html, "Technical Overview-Advanced Control Solutions," 6 pages, printed Sep. 9, 2004.

Kelly, et al., "Reducing Soot Emissions from Diesel Engines Using One Atmosphere Uniform Glow Discharge Plasma," SAE Paper No. 2003-01-1183, Mar. 2003.

Kolmanovsky, et al., "Issues in Modeling and Control of Intake Flow in Variable Geometry Turbocharged Engines", 18th IFIP Conf. System Modeling and Optimization, pp. 436-445, Jul. 1997.

Kulhavy, et al. "Emerging Technologies for Enterprise Optimization in the Process Industries," Honeywell, 12 pages, Dec. 2000.

Locker, et al., "Diesel Particulate Filter Operational Characterization," Corning Incorporated, 10 pages, prior to filing date of present application.

Lu, "Challenging Control Problems and Engineering Technologies in Enterprise Optimization," Honeywell Hi-Spec Solutions, 30 pages, Jun. 4-6, 2001.

Moore, "Living with Cooled-EGR Engines," Prevention Illustrated, 3 pages. Oct. 3, 2004.

National Renewable Energy Laboratory (NREL), "Diesel Emissions Control- Sulfur Effects Project (DECSE) Summary of Reports," U.S. Department of Energy, 19 pages, Feb. 2002.

Salvat, et al., "Passenger Car Serial Application of a Particulate Filter System on a Common Rail Direct Injection Engine," SAE Paper No. 2000-01-0473, 14 pages, Feb. 2000.

Shamma, et al. "Approximate Set-Valued Observers for Nonlinear Systems," IEEE Transactions on Automatic Control, vol. 42, No. 5, May 1997.

Soltis, "Current Status of NOx Sensor Development," Workshop on Sensor Needs and Requirements for PEM Fuel Cell Systems and Direct-Injection Engines, 9 pages, Jan. 25-26, 2000.

Stefanopoulou, et al., "Control of Variable Geometry Turbocharged Diesel Engines for Reduced Emissions," IEEE Transactions on Control Systems Technology, vol. 8, No. 4, pp. 733-745, Jul. 2000.

Storset, et al., "Air Charge Estimation for Turbocharged Diesel Engines," vol. 1 Proceedings of the American Control Conference, 8 pages, Jun. 28-30, 2000.

The MathWorks, "Model-Based Calibration Toolbox 2.1 Calibrate complex powertrain systems," 4 pages, printed prior to filing date of present application.

The MathWorks, "Model-Based Calibration Toolbox 2.1.2," 2 pages, prior to filing date of present application.

Theiss, "Advanced Reciprocating Engine System (ARES) Activities at the Oak Ridge National Lab (ORNL), Oak Ridge National Laboratory," U.S. Department of Energy, 13 pages, Apr. 14, 2004.

Van Basshuysen et al., "Lexikon Motorentechnik," (Dictionary of Automotive Technology) published by Vieweg Verlag, Wiesbaden 039936, p. 518, 2004. (English Translation).

Zenlenka, et al., "An Active Regeneration as a Key Element for Safe Particulate Trap Use," SAE Paper No. 2001-0103199, 13 pages, Feb. 2001.

All Foreign References & NPL Art Has Been Previously Cited in Parent U.S. Appl. No. 11/206,404.

* cited by examiner

EMISSIONS SENSORS FOR FUEL CONTROL IN ENGINES

The present application is a continuation of U.S. application Ser. No. 11/206,404 filed Aug. 18, 2005, entitled, "EMISSIONS SENSORS FOR FUEL CONTROL IN ENGINES."

BACKGROUND

The present invention pertains to engines and particularly to fuel control for internal combustion engines. More particularly, the invention pertains to fuel control based on contents of engine exhaust.

SUMMARY

The present invention includes fuel control of an engine based on emissions in the exhaust gases of the engine.

DESCRIPTION

Figure 1:
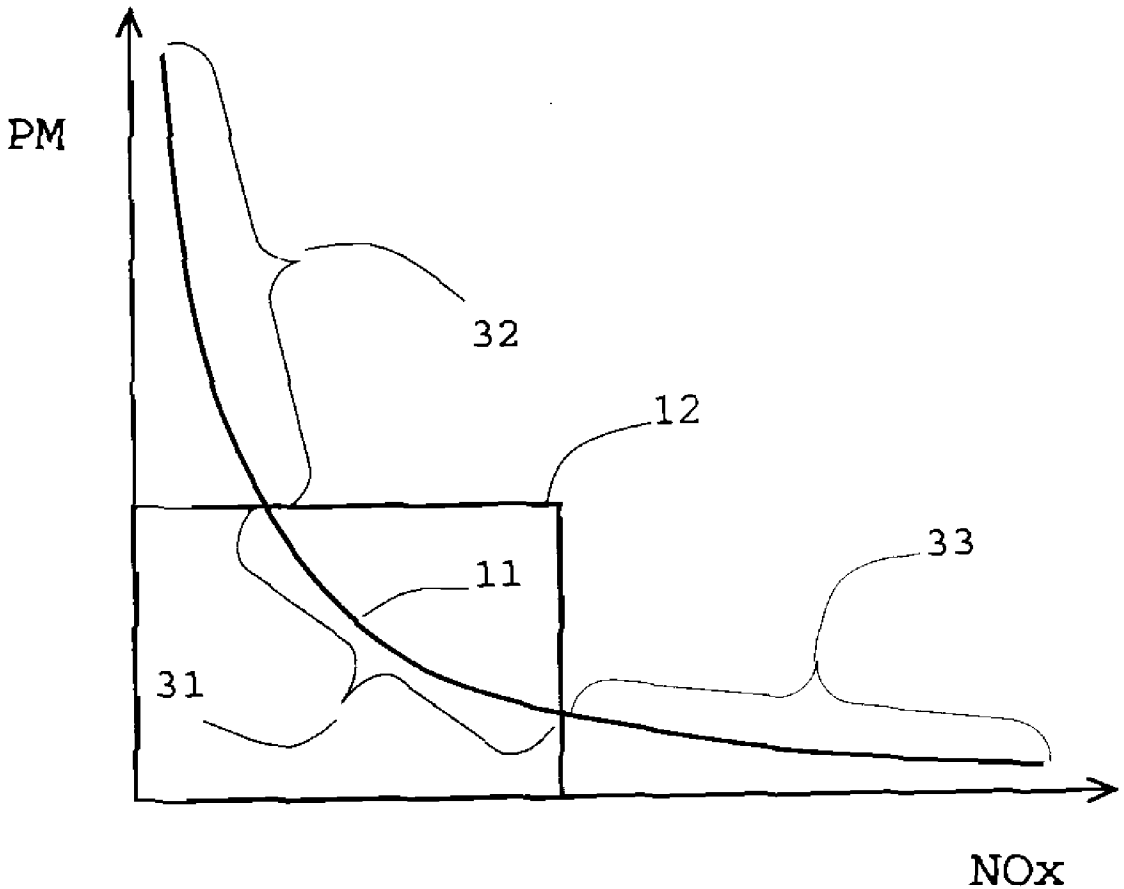
FIG. 1 is a chart showing the standard diesel engine tradeoff between particulate matter and nitrogen oxide emissions of an engine.

Engines often use catalytic converters and oxygen sensors to help control engine emissions. A driver-commanded pedal is typically connected to a throttle that meters air into engine. That is, stepping on the pedal directly opens the throttle to allow more air into the engine. Oxygen sensors are often used to measure the oxygen level of the engine exhaust, and provide feed back to a fuel injector control to maintain the desired air/fuel ratio (AFR), typically close to a stoichiometric air-fuel ratio to achieve stoichiometric combustion. Stoichiometric combustion can allow three-way catalysts to simultaneously remove hydrocarbons, carbon monoxide, and oxides of nitrogen (NOx) in attempt to meet emission requirements for the spark ignition engines.

Compression ignition engines (e.g., diesel engines) have been steadily growing in popularity. Once reserved for the commercial vehicle markets, diesel engines are now making real headway into the car and light truck markets. Partly because of this, federal regulations were passed requiring decreased emissions in diesel engines.

Many diesel engines now employ turbochargers for increased efficiency. In such systems, and unlike most spark ignition engines, the pedal is not directly connected to a throttle that meters air into engine. Instead, a pedal position is used to control the fuel rate provided to the engine by adjusting a fuel "rack", which allows more or less fuel per fuel pump shot. The air to the engine is typically controlled by the turbocharger, often a variable nozzle turbocharger (VNT) or waste-gate turbocharger.

Traditional diesel engines can suffer from a mismatch between the air and fuel that is provided to the engine, particularly since there is often a time delay between when the operator moves the pedal, i.e., injecting more fuel, and when the turbocharger spins-up to provide the additional air required to produced the desired air-fuel ratio. To shorten this "turbo-lag", a pedal position sensor (fuel rate sensor) may be added and fed back to the turbocharger controller to increase the natural turbo acceleration, and consequently the air flow to the engine which may for example set the vane positions of a VNT turbocharger.

The pedal position is often used as an input to a static map, the output of which is in turn used as a setpoint in the fuel injector control loop which may compare the engine speed setpoint to the measured engine speed. Stepping on the pedal increases the engine speed setpoint in a manner dictated by the static map. In some cases, the diesel engine contains an air-fuel ratio (AFR) estimator, which is based on input parameters such as fuel injector flow and intake manifold air flow, to estimate when the AFR is low enough to expect smoke to appear in the exhaust, at which point the fuel flow is reduced. The airflow is often managed by the turbocharger, which provides an intake manifold pressure and an intake manifold flow rate for each driving condition.

In diesel engines, there are typically no sensors in the exhaust stream analogous to the oxygen sensors found in spark ignition engines. Thus, control over the combustion is often performed in an "open-loop" manner, which often relies on engine maps to generate set points for the intake manifold parameters that are favorable for acceptable exhaust emissions. As such, engine air-side control is often an important part of overall engine performance and in meeting exhaust emission requirements. In many cases, control of the turbocharger and EGR systems are the primary components in controlling the emission levels of a diesel engine.

Diesel automotive emissions standards today and in the future may be partly stated in terms of particulate matter (soot) and nitrogen oxides (NOx). Direct measurement feedback on the true soot measurement may have significant advantages over an air-fuel ratio (AFR) in the related art. The present system may enable one to read the soot directly rather than using an (unreliable) AFR estimation to infer potential smoke. Particulate matter (PM) and NOx sensor readings may be used for fuel injection control in diesel engines. The NOx and PM may both be regulated emissions for diesel engines. Reduction of both NOx and PM would be favorable. There may be a fundamental tradeoff between NOx and PM such that for most changes made to a diesel engine, reducing the engine-out PM is typically accompanied by an increase in engine-out NOx and vice versa. In FIG. 1, the abscissa indicates a magnitude of PM and the ordinate indicates a magnitude of NOx in an engine exhaust gas. An engine's PM and NOx emissions may be indicated with a curve 11. An area 12 represents the maximum emissions for an engine exhaust gas. A PM sensor may be good for characterizing the PM part of the curve 11 (typically associated with a rich combustion, high exhaust gas recirculation (EGR) rates, or otherwise). A NOx sensor may be well suited to characterize the "other extreme" of curve 11 representing a diesel engine combustion (typically associated with lean, hot burn, low EGR, and the like). The present invention may incorporate the notion that a diesel emissions control problem requires both ends of the diesel combustion to be covered by emissions sensing. NOx and PM sensors may give information that is synthesized into an understanding of the diesel combustion. This is important since both NOx and PM are increasingly tightly legislated emissions in many countries.

Some fuel injection handles or parameters may have certain impacts on NOx and PM emissions. Examples may include an early start of the injection which may result in good brake specific fuel consumption (bsfc), low PM and high NOx. High rail pressure may result in increased NOx, low PM and slightly improved fuel consumption. A lean air-fuel ratio (AFR), achieved by reducing the total fuel quantity, may result in increased NOx and decreased PM. A rich air-fuel ratio (AFR) achieved by changing the total fuel quantity may result in decreased NOx and increased PM.

Figure 3:
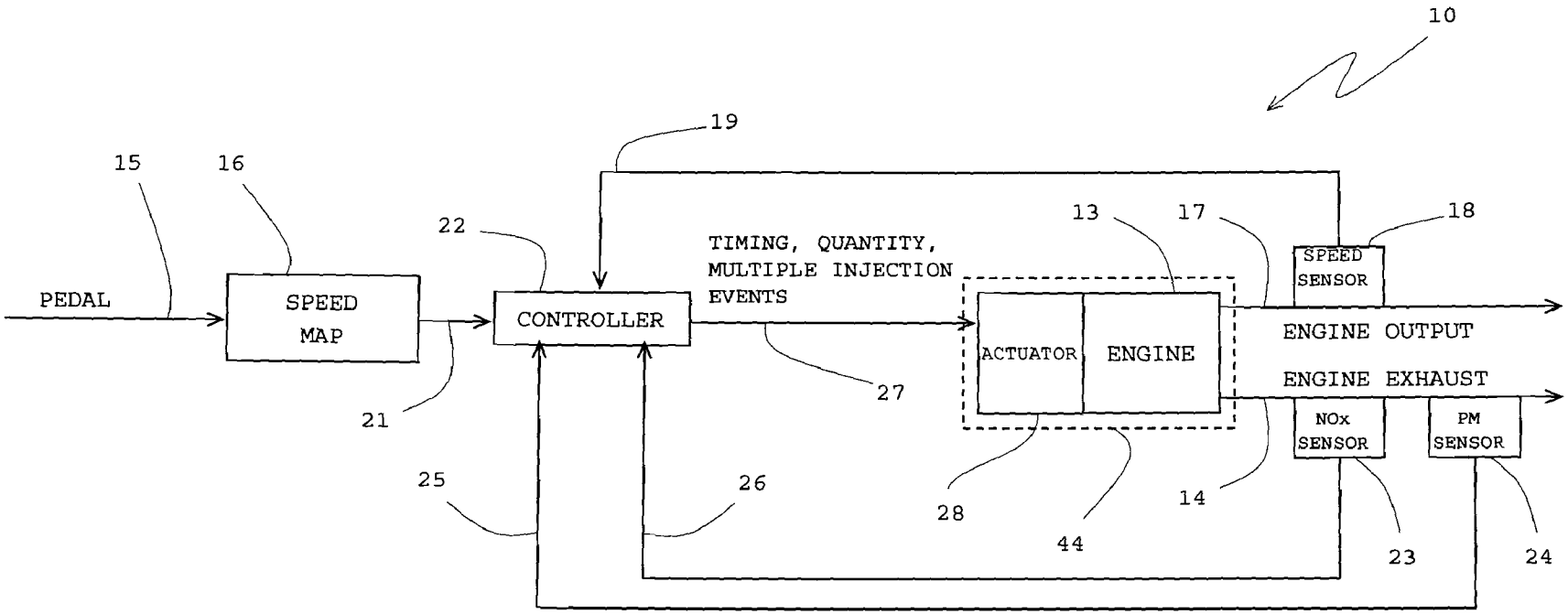
FIG. 3 is a diagram of an emission sensing and control system for engine fuel control.

FIG. 3 shows a fuel control system 10 for engine 13 based at least partially on engine exhaust 14 emissions. A pedal input 15 may be connected to a speed map 16 for controlling the speed of engine 13 output that may be used for driving a vehicle or some other mechanism. The speed of the engine output 17 may be detected by a speed sensor 18. Sensor 18 may provide an indication 19 of the speed to the speed map 16. The speed map 16 may combine the pedal signal 15 and the speed signal 19 to provide a fuel control signal 21 to a fuel rate limiter, fuel controller or other controller 22.

An NOx sensor 23, situated in exhaust 14, may provide a signal 25 indicating an amount of NOx sensed in exhaust 14. A PM sensor 24 may be situated in the exhaust 14 and provide a signal 26 indicating an amount of PM sensed in exhaust 14. The controller 22 may process signals 21, 25 and 26 into an output signal 27 to an actuator 28, such as a fuel injector and/or other actuator, of engine 13. Signal 27 may contain information relating to engine 13 control such as timing of fuel provisions, quantities of fuel, multiple injection events, and so forth. Signal 27 may go to an engine control unit 26, which in turn may sense and control various parameters of engine 11 for appropriate operation. Other emissions sensors, such as SOx sensors, may be utilized in the present system 10 for fuel control, emissions control, engine control, and so forth.

Figure 2:
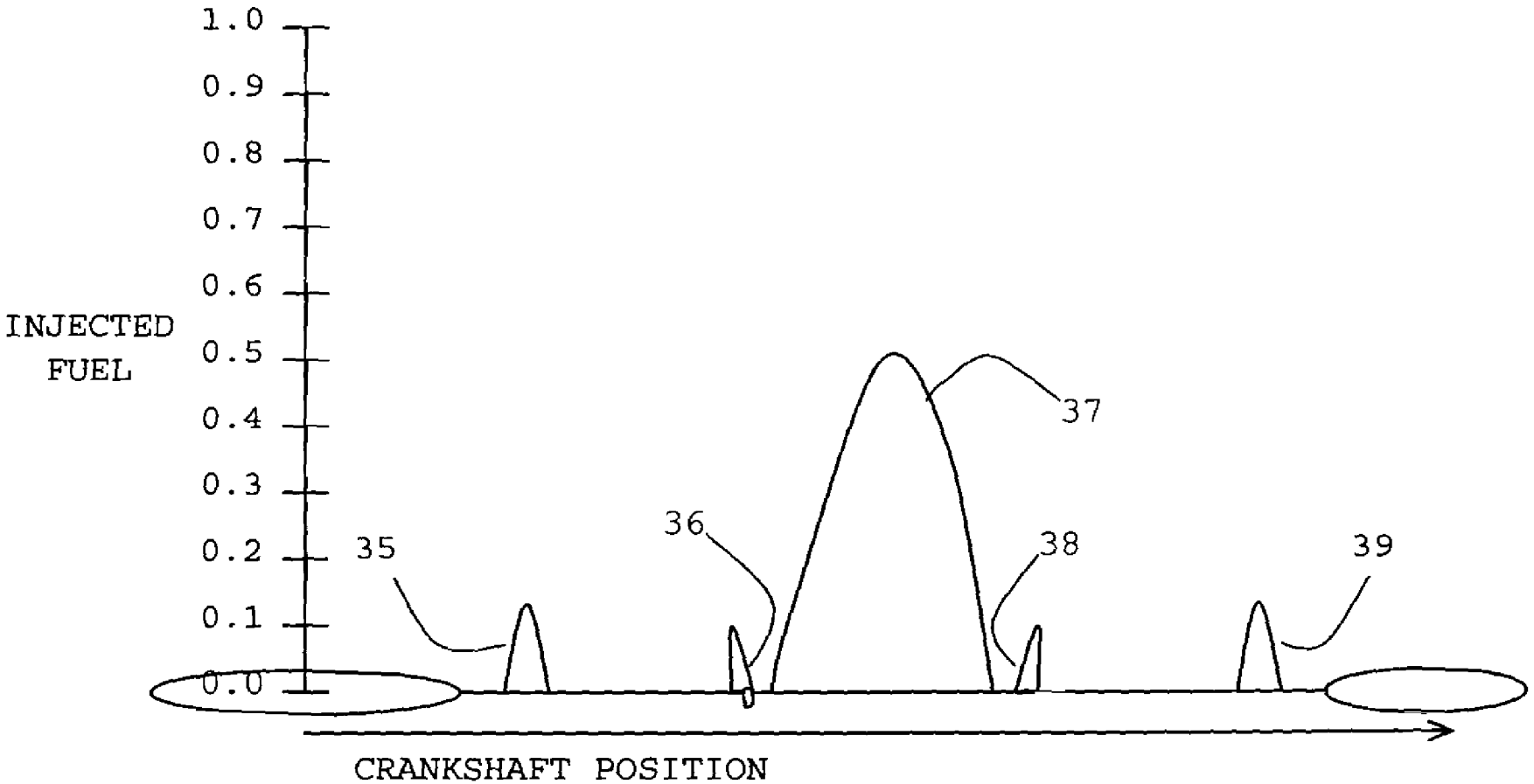
FIG. 2 is a graph of fuel injector events and the magnitudes reflecting some injection rate control for an engine.

Fuel injection systems may be designed to provide injection events, such as the pre-event 35, pilot event 36, main event 37, after event 38 and post event 39, in that order of time, as shown in the graph of injection rate control in FIG. 2. After-injection and post-injection events 38 and 39 do not contribute to the power developed by the engine, and may be used judiciously to simply heat the exhaust and use up excess oxygen. The pre-catalyst may be a significant part of the present process because all of the combustion does not take place in the cylinder.

In FIG. 3, signals 25 and 26 may indicate NOx and PM amounts in exhaust 14 to the fuel rate limiter, fuel controller or controller 22. The controller 22 may attempt to adjust or control fuel injection or supply, and/or other parameter, to the engine 13 so as to control or limit the NOx and PM emissions in the exhaust 14. The emissions may be maintained as represented by a portion 31 of the curve 11 in FIG. 1. The tradeoff between NOx and PM typically means that a reduction in PM may be accompanied by an increase in NOx and vice versa. The PM sensor 24 may be relied on for information at portion 32 of curve 11. The NOx sensor 23 may be relied on for sensing information at portion 33 of curve 11. Both sensors 23 and 24 may provide information in combination for attaining an emissions output of the exhaust 14 in the portion 31 of curve 11.

The PM sensor 24 may appropriately characterize the PM portion 32 of the curve 11 which typically may be associated for example with a rich combustion or a high exhaust recirculation rate. The NOx sensor 23 may be better suited to characterize the other extreme of the combustion which typically may be associated for example with a lean or hot burn and a low exhaust combustion rate.

In some cases, the controller 22 may be a multivariable model predictive Controller (MPC). The MPC may include a model of the dynamic process of engine operation, and provide predictive control signals to the engine subject to constraints in control variables and measured output variables. The models may be static and/or dynamic, depending on the application. In some cases, the models may produce one or more output signals y(t) from one or more input signals u(t). A dynamic model typically contains a static model plus information about the time response of the system. Thus, a dynamic model is often of higher fidelity than a static model.

In mathematical terms, a linear dynamic model has the form:

$$y(t)=B0*u(t)+B1*u(t-1)+\ .\ .\ .\ +Bn*u(t-n)+A1*y(t-1)+\ .\ .\ .\ +Am*y(t-m)$$

where B0 . . . Bn, and A1 . . . Am are constant matrices. In a dynamic model, y(t) which is the output at time t, may be based on the current input u(t), one or more past inputs u(t−1), . . . , u(t−n), and also on one or more past outputs y(t−1) . . . y(t−m).

A static model may be a special case where the matrices B1= . . . =Bn=0, and A1= . . . =Am=0, which is given by the simpler relationship:

$$y(t)=B0u(t)$$

A static model as shown is a simple matrix multiplier. A static model typically has no "memory" of the inputs u(t−1), u(t−2) . . . or outputs y(t−1) . . . and the like. As a result, a static model can be simpler, but may be less powerful in modeling some dynamic system parameters.

For a turbocharged diesel system, the system dynamics can be relatively complicated and several of the interactions may have characteristics known as "non-minimum phase". This is a dynamic response where the output y(t), when exposed to a step in input u(t), may initially move in one direction, and then turn around and move towards its steady state in the opposite direction. The soot (PM) emission in a diesel engine is just one example. In some cases, these dynamics may be important for optimal operation of the control system. Thus, dynamic models are often used, at least when modeling some control parameters.

In one example, the MPC may include a multivariable model that models the effect of changes in one or more actuators of the engine (e.g., fueling rate, and the like) on each of one or more parameters (e.g., engine speed 19, NOx 26, PM 25), and the multivariable controller may then control the actuators to produce a desired response in the two or more parameters. Likewise, the model may, in some cases, model the effects of simultaneous changes in two or more actuators on each of one or more engine parameters, and the multivariable controller may control the actuators to produce a desired response in each of the one or more parameters.

For example, an illustrative state-space model of a discrete time dynamical system may be represented using equations of the form:

$$x(t+1)=Ax(t)+Bu(t)$$

$$y(t)=Cx(t)$$

The model predictive algorithm involves solving the problem:

$$u(k)=\arg\min\{J\}$$

Where the function J is given by, $$J = \sum_{k=0}^{N_y-1} \hat{x}(t+N_y \mid t)^T P\hat{x}(t+N_y \mid t) + [\hat{x}(t+k \mid t)^T Q\hat{x}(t+k \mid t) + u(t+k)^T Ru(t+k)]$$

Subject to Constraints $$y_{min} \leqq \hat{y}(t+k|t) \leqq y_{max}$$

$$u_{min} \leqq u(t+k) \leqq u_{max}$$

$$x(t|t)=x(t)$$

$$\hat{x}(t+k+1t)=A\hat{x}(t+k|t)+Bu(t+k)$$

$$\hat{y}(t+k|t)=C\hat{x}(t+k|t)$$

In some examples, this is transformed into a quadratic programming (QP) problem and solved with standard or customized tools.

The variable "y(k)" may contain the sensor measurements (for the turbocharger problem, these include but are not limited to engine speed, NOx emissions, PM emissions, and so forth). The variables $\hat{y}(k+t|t)$ denote the outputs of the system predicted at time "t+k" when the measurements "y(t)" are available. They may be used in the model predictive controller to choose the sequence of inputs which yields the "best" (according to performance index J) predicted sequence of outputs.

The variables "u(k)" are produced by optimizing J and, in some cases, are used for the actuator set points. For the fuel controller problem these signals 27 may include, but are not limited to, the timing, quantity, multiple injection events, and so forth. The variable "x(k)" is a variable representing an internal state of the dynamical state space model of the system. The variable $\hat{x}(t+k|t)$ indicates the predicted version of the state variable k discrete time steps into the future and may be used in the model predictive controller to optimize the future values of the system.

The variables ymin and ymax are constraints and may indicate the minimum and maximum values that the system predicted measurements $\hat{y}(k)$ are permitted to attain. These often correspond to hard limits on the closed-loop behavior in the control system. For example, a hard limit may be placed on the PM emissions such that they are not permitted to exceed a certain number of grams per second at some given time. In some cases, only a minimum ymin or maximum ymax constraint is provided. For example, a maximum PM emission constraint may be provided, while a minimum PM emission constraint may be unnecessary or undesirable.

The variables umin and umax are also constraints, and indicate the minimum and maximum values that the system actuators $\hat{u}(k)$ are permitted to attain, often corresponding to physical limitations on the actuators. For example, the fuel quantity may have a minimum value and a maximum value corresponding to the maximum fuel rate achievable by the actuator. Like above, in some cases and depending on the circumstances, only a minimum umin or maximum umax constraint may be provided. Also, some or all of the constraints (e.g. ymin, ymax, umin, umax) may vary in time, depending on the current operating conditions. The state and actuator constraints may be provided to the controller 22 via an interface.

The constant matrices P, Q, R are often positive definite matrices used to set a penalty on the optimization of the respective variables. These may be used in practice to "tune" the closed-loop response of the system.

Figure 4:
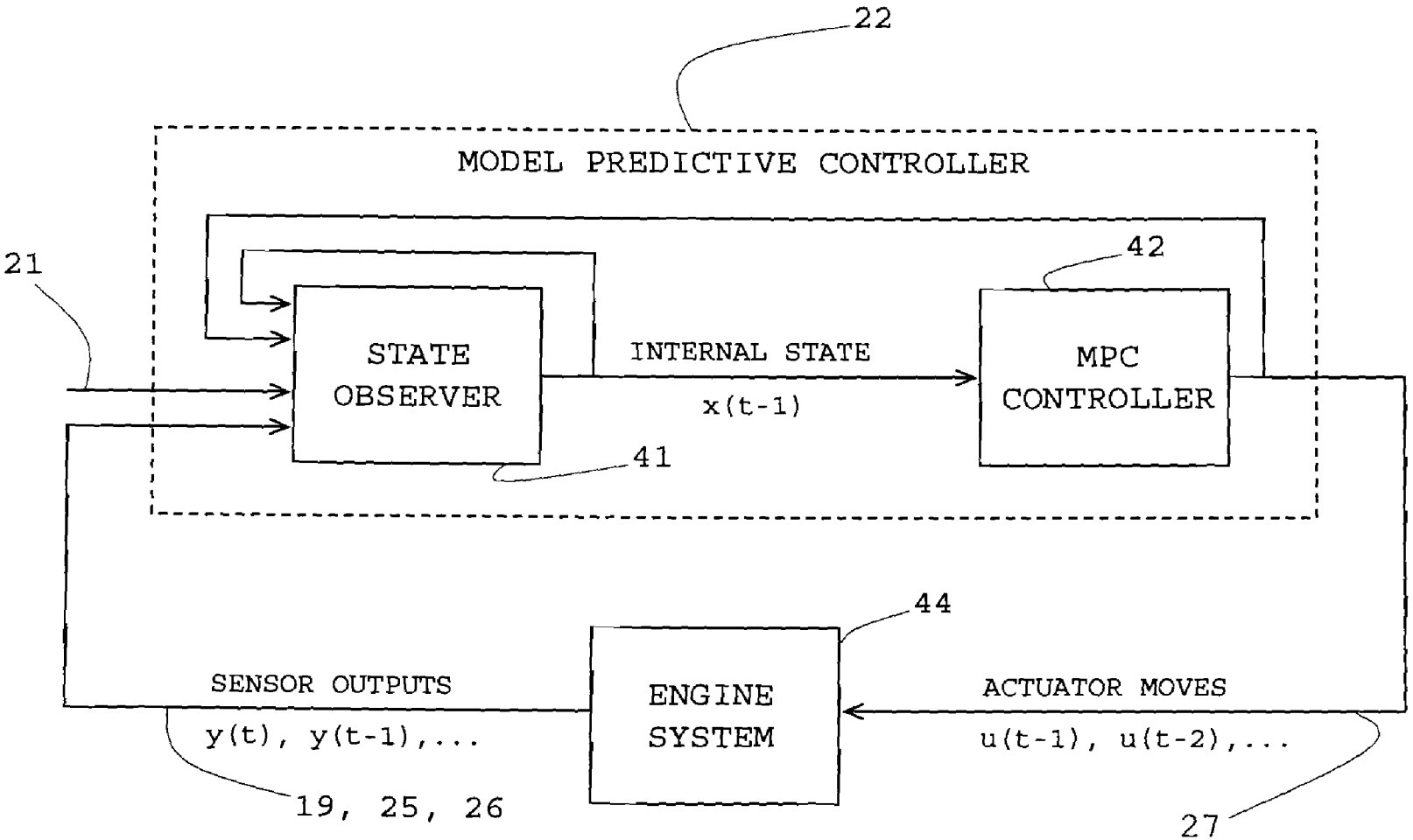
FIG. 4 is a schematic view of an illustrative model predictive controller.

FIG. 4 is a schematic view of an illustrative model predictive controller. In this example, the MPC 22 may include a state observer 41 and a MPC controller 42. The MPC Controller 84 provides a number of control outputs "u" to actuators or the like of the engine 13. Illustrative control outputs 27 include, for example, the timing, quantity, multiple injection events, and so forth. The MPC controller may include a memory for storing past values of the control outputs u(t), u(t−1), u(t−2), and the like.

The state observer 41 may receive a number of inputs "y", a number of control outputs "u", and a number of internal variables "x". Illustrative inputs "y" include, for example, the engine speed signal 19, the NOx sensor 23 output 26, and/or the PM sensor 24 output 25. It is contemplated that the inputs "y" may be interrogated constantly, intermittently, or periodically, or at any other time, as desired. Also, these input parameters are only illustrative, and it is contemplated that more or less input signals may be provided, depending on the application. In some cases, the state observer may receive present and/or past values for each of the number of inputs "y", the number of control outputs "u", and a number of internal state variables "x", depending on the application.

The state observer 41 may produce a current set of state variables "x", which are then provided to the MPC controller 42. The MPC controller 42 may then calculate new control outputs "u", which are presented to actuators or the like on the engine 13. The control outputs "u" may be updated constantly, intermittently, or periodically, or at any other time, as desired. The engine system 44 may operate using the new control outputs "u", and produces new inputs "y".

In one illustrative example, the MPC 22 may be programmed using standard quadratic programming (QP) and/or linear programming (LP) techniques to predict values for the control outputs "u" so that the engine system 44 produces inputs "y" that are at a desired target value, within a desired target range, and/or do not violate any predefined constraints. For example, by knowing the impact of the fuel quantity and timing, on the engine speed, NOx and/or PM emissions, the MPC 22 may predict values for the control outputs 27 fuel quantity and timing so that future values of the engine speed 19, NOx 24 and/or PM 23 emissions are at or remain at a desired target value, within a desired target range, and/or do not violate current constraints.

The MPC 22 may be implemented in the form of online optimization and/or by using equivalent lookup tables computed with a hybrid multi-parametric algorithm. Hybrid multi-parametric algorithms may allow constraints on emission parameters as well as multiple system operating modes to be encoded into a lookup table which can be implemented in an engine control unit (ECU) of an engine. The emission constraints may be time-varying signals which enter the lookup table as additional parameters. Hybrid multi-parametric algorithms are further described by F. Borrelli in "Constrained Optimal Control of Linear and Hybrid Systems", volume 290 of Lecture Notes in Control and Information Sciences, Springer, 2003, which is incorporated herein by reference.

Alternatively, or in addition, the MPC 22 may include one or more proportional-integral-derivative (PID) control loops, one or more predictive constrained control loops—such as a Smith predictor control loop, one or more multiparametric control loops, one or more multivariable control loops, one or more dynamic matrix control loops, one or more statistical processes control loop, a knowledge based expert system, a neural network, fuzzy logic or any other suitable control mechanism, as desired. Also, the MPC may provide commands and/or set points for lower-level controllers that are used to control the actuators of the engine. In some cases, the lower level controllers may be, for example, single-input-single-output (SISO) controllers such as PID controllers.

Figure 5:
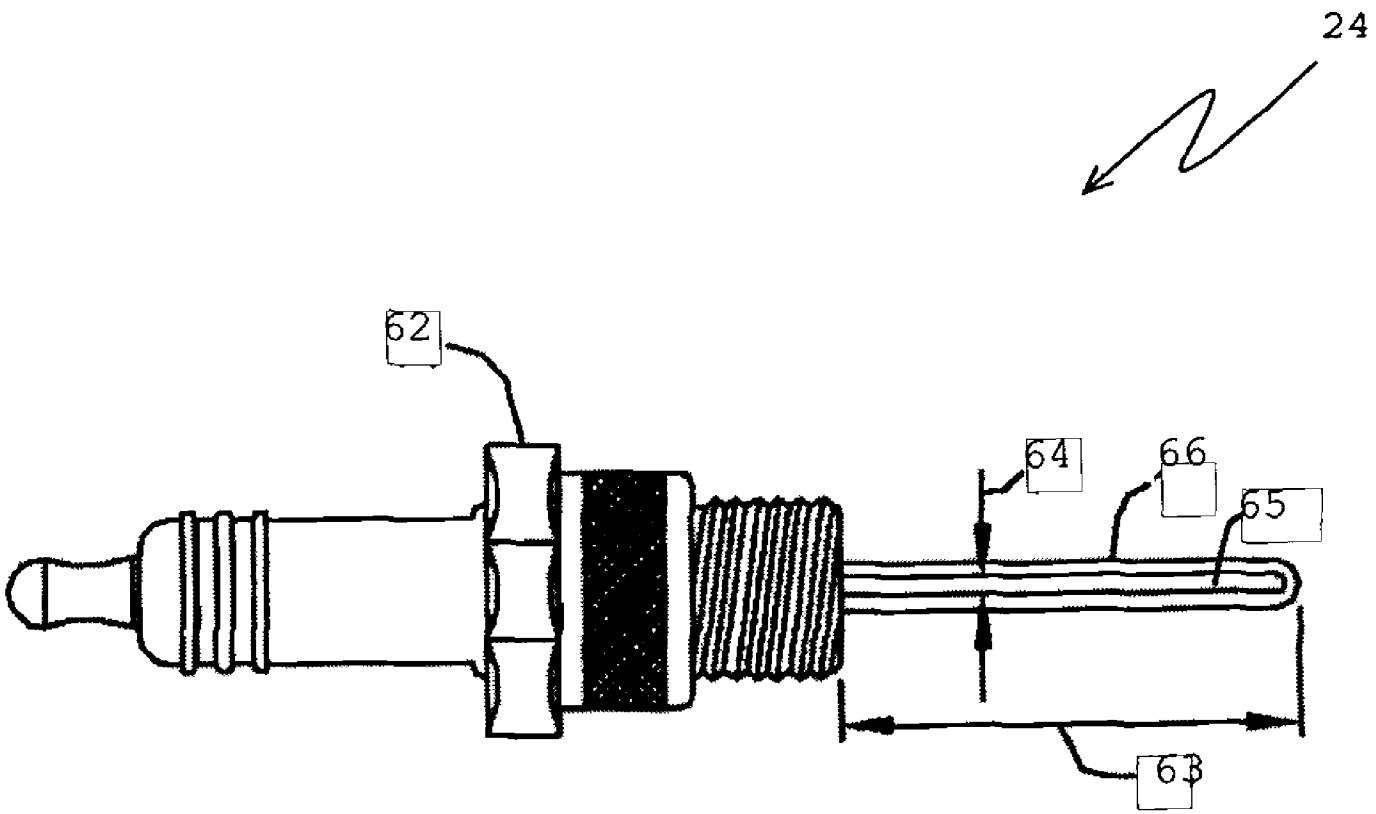
FIG. 5 shows a particulate matter sensor.

The PM sensor 24 may have a spark-plug-like support 62 as shown in FIG. 5. The PM sensor may provide an output based on the PM formed on the probe. The sensor or probe may be placed in a path of the exhaust of the engine 13. The length 63 and diameter 64 of a probe electrode 65 may vary depending on the parameters of the sensing electronics and the engine. The probe electrode 65 may be passivated with a very thin conductive coating or layer 66 on it. This coating or layer 66 may prevent electrical shorting by the soot layer accumulated by the probe during the operation of engine 13. The passivation material 66 may be composed of SiN4, cerium or other oxide, and/or the like. The thickness of the passivation layer 66 on the probe electrode 65 may be between 0.001 and 0.020 inch. A nominal thickness may be about 0.01 inch. The passivation layer 66 may be achieved with the probe electrode 65 exposed to high exhaust temperatures or may be coated with a layer via a material added to the engine's fuel.

Sensor or probe 24 may have various dimensions. Examples of an electrode 65 length dimension 63 may be between 0.25 and 12 inches. A nominal value of the length 63 may be about 3 to 4 inches. Examples of a thickness or diameter dimension 64 may be between 1/32 inch and 3/8 inch. A nominal thickness may be about 1/8 inch.

An example of the probe may include a standard spark plug housing 62 that has the outside or ground electrode removed and has a 4 to 6 inch metal extension of about 1/8 inch thickness or diameter welded to a center electrode. The sensor 24 may be mounted in the exhaust stream near an exhaust manifold or after a turbocharger, if there is one, of the engine 13. The sensing electrode 65 may be connected to an analog charge amplifier of a processing electronics. The charge transients from the electrode 65 of probe 24 may be directly proportional to the soot (particulate) concentration in the exhaust stream. The extended electrode 65 may be passivated with a very thin non-conducting layer 66 on the surface of the electrode 65 exposed to the exhaust gas of the engine 13. For an illustrative example, a 304 type stainless steel may grow the passivating layer 66 on the probe electrode 65 spontaneously after a few minutes of operation in the exhaust stream at temperatures greater than 400 degrees C. (750 degrees F.). However, a passivating layer 66 of cerium oxide may instead be grown on the probe electrode 65 situated in the exhaust, by adding an organometallic cerium compound (about 100 PPM) to the fuel for the engine 13.

Other approaches of passivating the probe or electrode 65 with a layer 66 may include sputter depositing refractory ceramic materials or growing oxide layers in controlled environments. Again, the purpose of growing or depositing the passivating layer 66 on electrode 65 situated in the exhaust is to prevent shorts between the electrode and the base of the spark-plug like holder 62 due to PM buildups, so that sensor or probe 24 may retain its image charge monitoring activity of the exhaust stream. If the electrode 65 did not have the passivating layer 66 on it, probe 24 may fail after a brief operating period because of an electrical shorting of the electrode 65 to the support base 62 of the sensor due to a build-up of soot or PM on the electrode.

In summary, the controller may have one or more look-up tables (e.g., incorporating a multi-parametric hybrid algorithm), time-varying emission control restraints, proportional-integral-derivative (PID) control loops, predictive constrained control loops (e.g., including a Smith predictor), multi-parametric control loops, model-based predictive control loops, dynamic matrix control loops, statistical processes control loops, knowledge-based expert systems, neural networks, and/or fuzzy logic schemes.

In the present specification, some of the matter may be of a hypothetical or prophetic nature although stated in another manner or tense.

Although the invention has been described with respect to at least one illustrative example, many variations and modifications will become apparent to those skilled in the art upon reading the present specification. It is therefore the intention that the appended claims be interpreted as broadly as possible in view of the prior art to include all such variations and modifications.

What is claimed is:

1. A control system for an engine of a driven vehicle, comprising:

one or more actuators for controlling one or more inputs to an engine;

at least one engine emission sensor, each of the at least one engine emission sensors for sensing an emission parameter, wherein the at least one emissions sensors detect NOx and PM;

a controller coupled to the one or more actuators and the at least one engine emission sensor, the controller including a multi-parameter model that models the effects of changes in the one or more actuators on each of two or more engine operating parameters based on the sensed emission parameters while the vehicle is being driven by a user; and wherein the controller is configured to adjust at least one actuator of the engine and make a change to one or more inputs to the engine in order to produce a controlled change in each of the two or more engine operating parameters as modeled by the multi-parameter model while the vehicle is being driven by a user.

2. The control system of claim 1 wherein the multi-parameter model models the effects of changes in the one or more actuators on each of two or more engine operating parameters including at least one emission parameter.

3. The control system of claim 1, wherein the controller is a fuel controller.

4. The control system of claim 3, wherein the fuel controller is configured to adjust at least one actuator of the engine and make a change to one or more inputs to the engine in order to produce a controlled change in each of the two or more engine operating parameters as modeled by the multi-parameter model including the at least one emission parameter.

5. The control system of claim 4, further comprising:

a speed sensor connected to the controller for sensing the speed of the engine; and at least one of the actuators for controlling the speed of the engine.

6. The control system of claim 1, wherein the controller adjust at least one actuator of the engine to produce a controlled change in each of the amounts of NOx and PM emissions for a sensed engine speed.

7. The control system of claim 1, wherein the controller comprises one or more dynamic matrix control loops.

8. The control system of claim 1, wherein the controller comprises one or more statistical processes control loops.

9. The control system of claim 1, wherein the controller comprises a knowledge-based expert system.

10. The control system of claim 1, wherein the controller comprises a neural network.

11. The control system of claim 1, wherein the controller comprises fuzzy logic.

12. An engine control system for a driven vehicle, comprising:

one or more actuators for controlling one or more inputs to an engine;

a vehicle controller coupled to one or more of the actuators, the vehicle controller controlling the fuel profile that is delivered to the engine while the vehicle is being driven by a user;

an emissions sensor connected to the vehicle controller, the emission sensor for sensing an emission parameter of the engine, wherein the emission sensor includes a NOx sensor;

wherein the vehicle controller includes a multi-parameter model that models the effects of changes in the one or more actuators on each of two or more engine operating parameters including the emission parameter; and wherein the vehicle controller is configured to adjust at least one actuator of the engine, including a fuel actuator, in order to produce a controlled change in each of the two or more engine operating parameters including the emission parameter, as modeled by the multi-parameter model, while the vehicle is being driven by the user.

13. The engine control system of claim 12 wherein the multi-parameter model includes one or more predictive control loops.

14. The engine control system of claim 13, wherein the one or more predictive control loops are constrained.

15. The engine control system of claim 2, wherein the multi-parameter model comprises a look-up table.

16. The engine control system of claim 15, wherein the look-up table is computed using a multi-parametric hybrid algorithm.

17. The engine control system of claim 12, wherein the multi-parameter model comprises one or more emission control constraints which are time-varying.

18. The engine control system of claim 12, wherein the multi-parameter model comprises one or more proportional-integral-derivative (PID) control loops.

19. The engine control system of claim 12, further comprising a second emissions sensor connected to the vehicle controller, the second emission sensor for sensing a second emission parameter of the engine, wherein the second emission sensor is a PM sensor.

20. An emissions control system for a diesel engine of a driven vehicle, the emission control system comprising:

a fuel controller configured to provide on-line fuel control of the diesel engine during engine operation while the vehicle is being driven by a user; and two or more emissions sensors connected to the fuel controller, wherein a first emission sensor is a PM sensor situated in an exhaust system of the engine; and wherein the fuel controller is configured to at least partially adjust at least one parameter of an engine in accordance with signals from the two or more emissions sensors, wherein the fuel controller comprises one or more predictive control loops.

21. The emissions control system of claim 20 wherein a second emission sensor is a NOx sensor.

22. A control system for an engine of a driven vehicle, comprising:

one or more actuators for controlling one or more inputs to an engine;

at least two engine sensors, each of the at least two engine sensors for sensing a sensed engine parameter;

a controller coupled to the one or more actuators and the at least two engine sensors, the controller including a multi-parameter model that models the effects of changes in the one or more actuators on each of the at least two sensed engine parameters; and wherein the controller is configured to adjust at least one actuator of the engine such that a performance index is optimized while the vehicle is being driven by a user, the performance index including terms that are related to the at least two sensed engine parameters.

* * * * *